US011787215B2

(12) United States Patent
Mayade

(10) Patent No.: US 11,787,215 B2
(45) Date of Patent: Oct. 17, 2023

(54) TRANSFER PAPER FOR SUBLIMATION PRINTING, COMPRISING AN ALKALINE EARTH SALT

(71) Applicant: AHLSTROM OYJ, Helsinki (FI)

(72) Inventor: Thierry Mayade, Paladru (FR)

(73) Assignee: AHLSTROM OYJ, Helsinki (FI)

( * ) Notice: Subject to any disclaimer, the term of this patent is extended or adjusted under 35 U.S.C. 154(b) by 24 days.

(21) Appl. No.: 16/477,226

(22) PCT Filed: Jan. 10, 2018

(86) PCT No.: PCT/EP2018/050556
§ 371 (c)(1),
(2) Date: Jul. 11, 2019

(87) PCT Pub. No.: WO2018/130567
PCT Pub. Date: Jul. 19, 2018

(65) Prior Publication Data

US 2019/0390401 A1 Dec. 26, 2019

(30) Foreign Application Priority Data

Jan. 12, 2017 (FR) ..... 1750253

(51) Int. Cl.
*B41M 5/50* (2006.01)
*B41M 5/52* (2006.01)

(52) U.S. Cl.
CPC ..... *B41M 5/5245* (2013.01); *B41M 5/5218* (2013.01)

(58) Field of Classification Search
CPC ..... B41M 5/5245; B41M 5/5218
USPC ..... 428/32.3
See application file for complete search history.

(56) References Cited

U.S. PATENT DOCUMENTS 4,410,899 A * 10/1983 Haruta ..... B41J 2/14129 347/100
5,250,494 A 10/1993 Wehrmann et al.
5,643,631 A 7/1997 Donigian et al.
6,880,928 B2 4/2005 Hosoi et al.
9,056,515 B2 6/2015 Wingkono et al.
2005/0281964 A1* 12/2005 Yamamoto ..... G03C 1/81 428/32.1
2007/0087138 A1* 4/2007 Koenig ..... B41M 5/52 428/32.21
2007/0286970 A1* 12/2007 Ogino ..... B41M 5/0035 428/32.21
2008/0229962 A1 9/2008 Shedd et al.
2009/0104383 A1* 4/2009 Terao ..... B44C 1/1716 428/32.1
2011/0111145 A1 5/2011 Katampe
2015/0130881 A1* 5/2015 Oguchi ..... C08K 5/3437 106/31.44
2018/0264864 A1* 9/2018 Dentani ..... D06P 5/004

FOREIGN PATENT DOCUMENTS

CN 102224294 A 10/2011
CN 102884145 A 1/2013
CN 103171351 A 6/2013
CN 204451574 U 7/2015
EP 1775141 A1 4/2007
EP 2965919 A1 1/2016
WO 99/06219 A1 2/1999
WO 0006392 A1 2/2000
WO 2001023664 A1 4/2001
WO 2005077663 A1 8/2005
WO 2008006434 A1 1/2008
WO 2012152281 A1 11/2012
WO 2015/116095 A1 8/2015
WO 2016074671 A2 5/2016
WO WO-2016136122 A1 * 9/2016 ..... B41M 5/508

OTHER PUBLICATIONS

The Second Office Action—Application No. 201880006656.0, The State Intellectual Property Office of People's Republic of China.
Kumar, N. et al., "Synthesis and application of calcium sulphate pigment for paper coating: Potential and prospects," Powder Technology, vol. 218, 2012; pp. 40-45.
Letter from Alkin, 2016; 1 page. Cited in EPO opposition for the European Patent Application No. 18705084.4.
Mondi Paper Sales GmbH, Invoice, 2016; 2 pages. Cited in EPO opposition for the European Patent Application No. 18705084.4.
Mondi Paper Sales GmbH, Order Confirmation, 2016; 2 pages. Cited in EPO opposition for the European Patent Application No. 18705084.4.
Mondi, Information, 2020; 1 page. Cited in EPO opposition for the European Patent Application No. 18705084.4.
Mondi, Order Confirmation, 2017; 4 pages. Cited in EPO opposition for the European Patent Application No. 18705084.4.
Mondi, Pre Dispatch Advice, 2017; 1 page. Cited in EPO opposition for the European Patent Application No. 18705084.4.
Mondi, QSI Tambour Report, 2016; 4 pages. Cited in EPO opposition for the European Patent Application No. 18705084.4.
QSI Tambour Report; 1 page. Cited in EPO opposition for the European Patent Application No. 18705084.4.
Screenshot; 1 page. Cited in EPO opposition for the European Patent Application No. 18705084.4.
Table with Results; 1 page. Cited in EPO opposition for the European Patent Application No. 18705084.4.

* cited by examiner

*Primary Examiner* — Betelhem Shewareged
(74) *Attorney, Agent, or Firm* — CANTOR COLBURN LLP

(57) ABSTRACT

The invention relates to transfer paper for sublimation printing, having one or more alkaline earth salts on at least one face thereof.

18 Claims, No Drawings

TRANSFER PAPER FOR SUBLIMATION PRINTING, COMPRISING AN ALKALINE EARTH SALT

PRIORITIES AND CROSS REFERENCES

This Application claims priority from International Application No. PCT/EP2018/050556 filed on 10 Jan. 2018 and French Application No. 1750253 filed on 12 Jan. 2017, the teachings of each of which are incorporated herein by reference in their entirety.

This invention relates to transfer papers for sublimation printing, and in particular but not exclusively to those for inkjet printing.

Sublimation printing enables an image to be made on a support such as a metal, glass, a plastic surface or a fabric using sublimable inks. Sublimable ink printing can be done by printing sublimable inks directly on the final support, or by indirect printing. In the case of indirect printing, the inks are first of all printed on paper, called transfer paper, then the image printed on the transfer paper is transferred by presses on to the final support. Application US 2008/0229962 describes such a printing process.

Applications EP 2965919 A1, WO00/06392, WO2008/006434, and WO2016/074671 disclose the transfer papers for sublimation printing.

In particular, application EP 2965919 A1 discloses a transfer paper containing a reservoir layer with an external face configured to receive sublimable inks and a barrier layer applied to the internal face of the reservoir layer, and configured to form a barrier to transport of the sublimable ink. The reservoir layer can also contain a small proportion of cationic polymer to fixing the sublimable ink pigments on to the surface of the transfer paper.

Application WO00/06392 describes a transfer paper containing a barrier layer with a porosity of at most 100 ml/min.

Application WO2008/006434 discloses a paper containing a layer having a semi-synthetic thermoplastic polymer.

Application WO2016/074671 describes a paper containing a layer with thermoplastic particles.

Transfer papers for sublimation printing printable by inkjet printing generally contain a barrier layer based on hydrophilic polymer, such as carboxymethyl cellulose, starch or polyvinyl alcohol, more or less filled with specific low surface area pigments such as kaolin or calcium carbonate, or high surface area pigments such as silicas.

The presence of a barrier layer based on hydrophilic polymer leads to long drying times, limiting printing rates and causing colour mixing and bleeding affecting the printing quality.

By introducing fillers, the above drawbacks can be attenuated but there is an accompanying formulation cost increase and/or limiting of the sublimation transfer rate.

There therefore exists a need, so far unsatisfied, to obtain a transfer paper for sublimation printing, printable by inkjet printing, with good printability and a limited drying time, a high transfer rate and low paper weight, in particular equal to or less than 50 g/m$^2$.

The invention aims to meet this need through a sublimation printing transfer paper having one or more alkaline earth salts on at least one side.

The transfer paper according to the invention has good printability, thanks in particular to the immobilisation of the ink on the surface by the alkaline earth salt(s).

The immobilisation of the surface ink pigments by the alkaline earth salt(s) improves the optical density after transfer and limits bleeding. The definition is thereby improved.

The alkaline earth salt(s) may be present on the said side of the paper in a quantity equal to or greater than 0.2 g/m$^2$, in particular equal to or greater than 0.5 g/m$^2$.

The transfer paper may contain a fibrous substrate, the alkaline earth salt(s) being deposited on the fibrous substrate by a surface treatment, in particular mono-layer of multi-layer.

The alkaline earth salt(s) may be present on a single side of the transfer paper that is to receive the printing.

The alkaline earth salt(s) are preferably chosen from among the calcium or magnesium salts or mixtures of them.

The alkaline earth salt may be calcium dichloride or calcium nitrate.

The alkaline earth salt may be magnesium sulphate or magnesium chloride.

The side of the transfer paper containing the alkaline earth salt(s) may also contain one or more organic cationic agents, in particular chosen from epichlorohydrin polyamines, in particular from polyepichorhydrin dimethylamines, polyethyleneimines and organic quaternary ammonium salts, preferably from organic quaternary ammonium salts, the cationic agent being in particular polydiallyldimethylammonium chloride, also called Poly-Dadmac. The latter can improve transfer.

On the side containing the alkaline earth salts, the transfer paper may lack other formulation ingredients such as binder, pigment, dispersant, wetting agent, thickener, insolubiliser, adhesive agent, optical brightener or colouring, or the transfer paper may contain other formulation ingredients on this side such as binder, pigment, dispersant, wetting agent, thickener, insolubiliser, adhesive agent, optical brightener or colouring, in an individual, or better total, quantity equal to or less than 13 times, in g/m$^2$, the quantity of cationic agent(s), for example equal to or less than 12 times, or 10 times, or 8 times or 5 times.

The absence or weak presence of these ingredients enables the ink fixing/ink drying compromise to be optimised.

The transfer paper may, at least on the side containing the alkaline earth salt(s), lack other formulation ingredients as above or contain on this side the other formulation ingredients in individual, or better total, quantity equal to or less than 10 g/m$^2$.

In the case where the transfer paper contains mineral fillers, these may be chosen from among calcium carbonate, kaolin, calcined kaolin, talc, $TiO_2$, hydroxides, in particular of aluminium $Al(OH)_3$ or magnesium, sulphates, in particular $BaSO_4$ or $CaSO_4$, natural or synthetic aluminium silicate, aluminium oxide, or mixtures of these.

Mineral fillers block the surface ink. The presence of alkaline earth salt(s) according to the present invention obviates the need for mineral fillers, or at least limits their quantity.

The transfer paper may, at least on the side containing the alkaline earth salt(s), lack binder or contain on this side one or more binders in a quantity equal to or less than 8 g/m$^2$.

The binder(s) may be chosen from among the water-soluble binders such as polyvinyl alcohol, starch, gelatine, soya or casein proteins or mixtures of these.

The transfer paper is preferably printable by inkjet printing.

The transfer paper may also be printable by rotary press.

The transfer paper preferably has a Bendtsen air permeability equal to or greater than 100 ml/min, in particular equal to or greater than 200 ml/min (according to standard ISO 5636-3).

Such air permeability confers an open structure on the paper. It ensures rapid drying of the ink applied to the transfer paper. It therefore allows a gain in productivity compared with a lower air permeability by increasing the drying rate of the ink.

The transfer paper preferably has a paper weight between 25 and 150 g/m$^2$, in particular between 30 and 75 g/m$^2$, or better, equal to or less than 50 g/m$^2$.

The transfer paper is generally single use.

The invention also relates to a manufacturing process for transfer paper for sublimation printing, in particular as previously described, in which a surface treatment is used to deposit, on at least one side of a fibrous substrate, one or more alkaline earth salts or one or more compounds which, in the presence of one or more other compounds carried by the fibrous substrate, form one or more alkaline earth salts in situ.

The surface treatment may be mono-layer or multi-layer.

The process according to the invention may include production of the fibrous substrate.

The surface treatment may be applied in-line or off-line.

The alkaline earth salt(s) may be deposited or formed on a single side of the fibrous substrate.

The fibrous substrate may contain natural and/or synthetic fibres, in particular long and short cellulose fibres.

A composition containing the alkaline earth salt(s) may be deposited on the said side of the fibrous substrate by the surface treatment, and the quantity of the composition deposited on the fibrous substrate may be between 0.2 and 15 g/m$^2$ by dry weight, preferably between 0.5 and 8 g/m$^2$.

The surface treatment may be carried out using a glue press, a film transfer press or a coating system, in particular of the type curtain coating, knife coating, air knife coating, crayon or by engraved cylinder.

The fibrous substrate before treatment may contain one or more compounds for forming one or more alkaline earth salts during production of the transfer paper.

The alkaline earth salt(s) may be formed during production of the transfer paper by the reaction of a compound deposited by the surface treatment on the fibrous substrate and another compound introduced in the mass when the fibrous substrate is being produced.

The alkaline earth salt(s) are for example formed during production of the transfer paper by and acid-base reaction on calcium carbonate, introduced in the mass during production of the fibrous substrate, with coating by an acidic glue press.

The invention also relates to a transfer paper for sublimation printing, printed, containing a transfer paper as defined previously and at least printing on the side of the transfer paper containing the alkaline earth salt(s), in particular inkjet printing of at least one sublimable ink.

The invention also relates to a process for printing transfer paper for sublimation printing, in which at least one ink is used, in particular by inkjet printing, to print the side containing the alkaline earth salt(s) of the previously defined transfer paper.

As a variant, the printing may be carried out by rotary press.

Printing may for example be four-colour printing with ink cartridges containing inks in primary colours, in particular black, cyan, yellow and magenta, and possibly secondary colours. The ink is formulated from water-based sublimable pigments.

The invention also relates to a process for decorating a support, in which the printing on a printed transfer paper as previously described is transferred to the support.

The support can be a metal, glass, a plastic surface or a fabric, in particular a fabric containing polyester, preferably a fabric containing mostly polyester.

EXAMPLES

Examples 1 to 6

The compositions described in the table below are each deposited by Mayer rod on one side of a fibrous substrate of the composition and properties described below. The fibrous substrates treated by these compositions for transfer papers.

Basic Paper Before Coating

Fibrous composition: 30% softwood+70% mixed short fibres

Basis weight=60 g/m$^2$

Cobb value 60 s=15 g/m$^2$

Bendtsen porosity=1500 ml/min

Coating formulations: composition and coating according to the table below.

The printing test is carried out on paper using a SAWGRASS SG400 printer, and transfer is by press at 200° C. for one minute on polyester fabric.

Black ink (SAWGRASS Sublijet black) is deposited on the side of the fibrous substrate treated by the composition. A solid black area of colour is thereby obtained. The transfer papers treated by the ink form printed transfer papers.

The optical density after transfer to the polyester fabric is measured with an X-rite 500 spectrodensitometer.

Proportions are expressed as dry weight.

The quantities of calcium carbonate, aluminium silicate, polyvinyl alcohol, sorbitol, polyDADMAC and alkaline earth salt are expressed in percentage as dry weight (% dry).

| Salt - type | | Example 1 CaCI2 | Example 2 MgSO4 | Example 3 CaNO3 | Example 4 CaCI2 | Example 5 CaCI2 | Example 6 — |
|---|---|---|---|---|---|---|---|
| Calcium carbonate | % dry | 0 | 0 | 0 | 76 | 0 | 18 |
| Aluminium silicate | % dry | 0 | 0 | 0 | 0 | 0 | 71 |
| Polyvinyl alcohol | % dry | 0 | 0 | 0 | 10 | 40 | 11 |
| Sorbitol | % dry | 0 | 0 | 0 | 0 | 20 | 0 |
| Polydadmac | % dry | 0 | 0 | 0 | 4 | 0 | 0 |
| Alkaline earth salt | % dry | 100 | 100 | 100 | 10 | 40 | 0 |
| Dry deposit | (g/m$^2$) | 1.05 | 0.99 | 0.91 | 6.1 | 0.85 | 1.36 |
| Dry salt weight | (g/m$^2$) | 1.05 | 0.99 | 0.91 | 0.61 | 0.34 | 0 |
| Optical density (solid black area of colour) | | 2.34 | 2.37 | 2.12 | 2.46 | 2.18 | 1.86 |
| Bendtsen air permeability | (ml/min) | >100 | >100 | >100 | >100 | >100 | >100 |

The printed transfer papers described in examples 1, 2, 3, 4 and 5, which are papers according to the invention, have an optical density greater than the printed transfer paper according to example 6 which is not according to the invention.

Examples A, B and C

The black ink in examples 1, 2 and 3 has been replaced by a solid red area of colour formed by printing yellow and magenta (SAWGRASS Sublijet), respectively in examples A, B and C. The results are given in the table below.

| Salt-type | | Example A CaCI2 | Example B MgSO4 | Example C CaNO3 |
|---|---|---|---|---|
| Calcium carbonate | % dry | 0 | 0 | 0 |
| Aluminium silicate | % dry | 0 | 0 | 0 |
| Polyvinyl alcohol | % dry | 0 | 0 | 0 |
| Sorbitol | % dry | 0 | 0 | 0 |
| Polydadmac | % dry | 0 | 0 | 0 |
| Salt | % dry | 100 | 100 | 100 |
| Dry deposit | ($g/m^2$) | 1.05 | 0.99 | 0.91 |
| Dry salt weight | ($g/m^2$) | 1.05 | 0.99 | 0.91 |
| Optical density (solid red area of colour) | | 1.99 | 1.58 | 1.56 |
| Bendtsen air permeability | (ml/min) | >100 | >100 | >100 |

Calcium dichloride gives and excellent optical density with the solid red area of colour.

The invention claimed is:

1. Transfer paper comprising a fibrous substrate and directly applied on at least one side of the fibrous substrate, a composition comprising an alkaline earth salt selected from calcium dichloride, calcium nitrate, magnesium sulphate and magnesium chloride wherein the transfer paper is a sublimation printing transfer paper and is free of calcium sulfate and barium sulfate.

2. Transfer paper according to claim 1, the alkaline earth salt(s) being present on the said side in a quantity equal to or greater than 0.2 $g/m^2$.

3. Transfer paper according to claim 1 lacking other surface treatment formulation ingredients on the side containing the alkaline earth salt(s).

4. Transfer paper according to claim 1, wherein the transfer paper is printable by inkjet printing.

5. Transfer paper according to claim 1 having a Bendtsen air permeability equal to or greater than 100 ml/min (ISO 5636-3).

6. Transfer paper according to claim 1 having a paper weight between 25 and 150 $g/m^2$.

7. Manufacturing process for a transfer paper for sublimation printing, according to claim 1, wherein a surface treatment is used to deposit, on at least one side of a fibrous substrate, one or more alkaline earth salts or one or more compounds which, in the presence of one or more other compounds carried by the fibrous substrate, form one or more alkaline earth salts in situ.

8. Manufacturing process for a transfer paper according to the preceding claim, wherein the fibrous substrate is manufactured and the surface treatment applied in-line or off-line.

9. Manufacturing process for a transfer paper according to claim 7, wherein surface treatment deposits a composition containing alkaline earth salt(s) on the said side of the fibrous substrate.

10. Manufacturing process for a transfer paper according to the preceding claim, wherein the quantity of the composition deposited on the side of the fibrous substrate is between 0.2 and 15 $g/m^2$ by dry weight, preferably between 0.5 and 8 $g/m^2$.

11. Manufacturing process for a transfer paper according to claim 7, wherein the surface treatment is applied using a size press, a film transfer press or a coating system, in particular a knife coating, air knife coating, crayon or curtain, or by engraved cylinder.

12. Transfer paper printed by sublimation printing, containing a transfer paper according to claim 1 and wherein at least one print on the side of the transfer paper contains the alkaline earth salt(s).

13. Process for printing transfer paper for sublimation printing, in which at least one ink is used to print, in particular by inkjet printing, the side containing the alkaline earth salt(s) of a transfer paper according to claim 1.

14. Process for decorating a support, wherein the printing on a transfer paper printed according to claim 12 is transferred to the support by sublimation.

15. Transfer paper according to claim 1 wherein the composition containing the alkaline earth salt is free of binder.

16. Transfer paper according to claim 1 wherein the composition containing the alkaline earth salt is free of mineral filler.

17. Transfer paper according to claim 1 wherein the composition containing the alkaline earth salt comprises 10 to 100 weight percent of the alkaline earth salt.

18. Transfer paper according to claim 1 wherein the composition containing the alkaline earth salt comprises 40 to 100 weight percent of the alkaline earth salt.

* * * * *